United States Patent [19]

Fischer et al.

[11] Patent Number: 4,565,233

[45] Date of Patent: Jan. 21, 1986

[54] METHOD AND APPARATUS FOR COMPACTING GRANULAR MOULDING MATERIALS

[75] Inventors: Kurt Fischer; Hans Tanner, both of Schaffhausen, Switzerland

[73] Assignee: Georg Fischer Aktiengesellschaft, Schaffhausen, Switzerland

[21] Appl. No.: 535,559

[22] Filed: Sep. 27, 1983

[30] Foreign Application Priority Data

Oct. 1, 1982 [CH] Switzerland ..... 5799/82

[51] Int. Cl.[4] ..... B22C 15/00

[52] U.S. Cl. ..... 164/37; 164/169

[58] Field of Search ..... 164/37, 169, 200, 201, 164/202

[56] References Cited

U.S. PATENT DOCUMENTS

| | | | |
|---|---|---|---|
| 1,533,220 | 4/1925 | Campbell | 164/195 X |
| 1,594,598 | 8/1926 | Campbell | 164/202 |

FOREIGN PATENT DOCUMENTS

| | | | |
|---|---|---|---|
| 1961234 | 6/1974 | Fed. Rep. of Germany . | |
| 2069384A | 8/1981 | United Kingdom | 164/169 |
| 350571 | 10/1972 | U.S.S.R. | 164/169 |
| 430941 | 7/1975 | U.S.S.R. | 164/169 |
| 521993 | 9/1976 | U.S.S.R. | 164/169 |
| 774776 | 11/1980 | U.S.S.R. | 164/169 |
| 933189 | 6/1982 | U.S.S.R. | 164/169 |

OTHER PUBLICATIONS

Kay, J. M. *An Introduction to Fluid Mechanics and Heat Transfer,* University Press, Cambridge, 1957, pp. 219–227.

*Mark's Standard Handbook for Mechanical Engineers,* McGraw-Hill, 8th Ed., 1978, pp. 4–48–4–50.

*Primary Examiner*—Kuang Y. Lin

*Assistant Examiner*—J. Reed Batten, Jr.

*Attorney, Agent, or Firm*—Walter C. Farley

[57] ABSTRACT

Loosely poured granular material is compacted by a burst of air under pressure which is built up in a space Q1 and is abruptly released through the outlet end of a passageway Q3 which opens toward the material surface. While the pressure in Q1 is being built up and until released, it is restrained by a sealing member which concurrently covers the outlet side of Q1, the input end of passage Q3 and an accelerating space Q2. The sealing member is held in place by a counterpressure in a space Q4 acting on a larger surface area than Q1. The pressure is suddenly decreased in Q4, abruptly unbalancing the pressures and releasing the pressurized gas from Q1 into Q3 and against the surface.

36 Claims, 5 Drawing Figures

METHOD AND APPARATUS FOR COMPACTING GRANULAR MOULDING MATERIALS

This invention relates to a method and apparatus for developing and using a surge of compressed gas to compact a mass of loosely dispensed granular moulding material.

BACKGROUND OF THE INVENTION

A number of processes are known for compacting granular moulding material including using the thrust of pressurized gas for compacting the loosely poured mass of moulding substance. Among these is a process and apparatus described in German AS No. 1,961,234, wherein gas pressure is built up from a pressure container and is then released to act in a thrust-like manner on the moulding mass by actuating a valve which releases the pressurized gas from a hollow space.

Because the volume of compressed gas which is necessary for the compacting must bear a certain ratio to the poured quantity of moulding material, relatively large quantities of compressed air with correspondingly large pressures are necessary for the quantities of moulding material needed in foundry moulds.

Because, on the one hand, a large surface action of the pressure gas thrust onto the moulding mass is needed for good compaction, and on the other hand the valve for controlling the movement of the mass cannot be chosen to be too large, a necessary compromise is to use high gas pressure with a relatively small valve. Then, in order to obtain the compressing action of the gas over a large surface area, a perforated plate for dispersing the pressurized gas over a large area is disposed beneath the valve opening.

However, high pressure, particularly in the range above 20 bar, has many disadvantages with regard to its use in this operation and the arrangement of a perforated plate constitutes an obstacle for effective transfer of the pressure force.

BRIEF SUMMARY OF THE INVENTION

Accordingly, an object of the present invention is to provide a process and apparatus for compacting a loosely poured mass of moulding material, especially material for foundry moulds, wherein the pressure thrust of relatively low pressure can be brought to bear over a large surface area and with an intensity of at least 50 bar/second on the surface of the moulding material and with which even large surface mould formats can be acted upon without disturbance.

Briefly described, the invention includes a method of compacting granular material, especially granular foundry moulding material, using the thrust of a pressurized gas against the exposed upper surface of a mass of moulding material loosely poured around a pattern, comprising the steps of establishing first, second and third volumetric spaces Q1, Q2 and Q3 all having openings facing in the same direction and having edges surrounding the openings, space Q3 additionally having a second opening facing toward the exposed surface, providing a sealing organ having at least one sealing surface movable between a sealing position in which the sealing surface closes the opening of spaces Q1, Q2 and Q3 and a released position in which the organ is spaced from the openings, establishing a pressurizable control space Q4 at least partially surrounding the organ and acting against a surface of the organ facing away from the sealing surface such that pressurized gas therein tends to urge the organ towards its sealing position, the surface area acted upon by the gas in space Q4 being greater than the surface area acted upon by the gas in space Q1, supplying a gaseous medium to space Q4 until the space is pressurized to a predetermined pressure level to hold the sealing organ in its sealing position, delivering a gaseous medium under pressure to space Q1 until that space is pressurized to a higher level than space Q4, no greater than 19 bar, the higher level being less than that required to overcome the force of the gas in space Q4, and abruptly decreasing the pressure in space Q4 to allow the force of the gas in space Q1 to overcome the force exerted by the gas in space Q4, thereby abruptly moving the sealing organ away from the opening of spaces Q1, Q2 and Q3 and suddenly increasing the surface area of the sealing organ acted upon by the pressure of the gas in space Q1, thereby fully moving the sealing organ away from spaces Q1, Q2 and Q3 and allowing sudden expansion of the gas in space Q1 to pass through space Q3 and create a pressure thrust against the moulding material surface, thus compacting the material.

In another aspect, the invention includes an apparatus for forming and guiding a gas pressure thrust for compacting granular moulding material, especially foundry moulding material, the material being loosely poured into a mould housing surrounding a pattern, the apparatus comprising the combination of a pressure housing having an interior volume Q1 and an outlet opening; means for supplying gas under pressure to the pressure housing to a predetermined pressure level; a control housing having an interior volume Q4; means for supplying gas under pressure to the control housing to a preselected pressure level; means defining at least one passageway extending from an inlet opening in a predetermined plane to an outlet opening facing the moulding material, the at least one passageway having an interior volume Q3, the inlet opening facing in the same direction as the outlet opening of the pressure housing; seal means in the control housing for closing the outlet opening of the pressure housing and the inlet opening of the passageway, the seal means being movable between a closed position in which the openings are isolated from each other and a release position in which the openings are uncovered and in fluid communication with each other, the gas under pressure in the control housing urging the seal means toward the closed position, and the gas under pressure in the pressure housing urging the seal means toward the release position; means defining an accelerator chamber having a volume Q2 and having an opening facing in the same direction as the outlet opening of the volume Q1 and the inlet opening of the volume Q3, the opening of the volume Q2 being closed by the seal means when the seal means is in the closed position, the means defining the chamber Q2 being effective to cover an accelerator surface portion of the seal means so that the surface area of the seal means acted upon by the gas in the volume Q1 is less than the surface area of the seal means acted on in the opposite direction by the gas in the volume Q4; and vent means for selectively decreasing the pressure in the volume Q4, whereby the volumes Q1 and Q4 can be pressurized to a substantially equal pressure level without moving the seal means from the closed position, after which the pressure in the volume Q4 can be abruptly decreased, permitting the force exerted by the gas in volume Q1 to move the seal means away from the volume Q2, suddenly enlarging the surface area acted upon by the gas in volume Q1 and reversing the force balance such that the seal means is abruptly moved to the release position, allowing the gas in volume Q1 to expand and pass rapidly through the at least one passageway to exert a sudden force on the exposed surface of the moulding material to thereby compact the material.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF THE DRAWINGS

Figure 1:
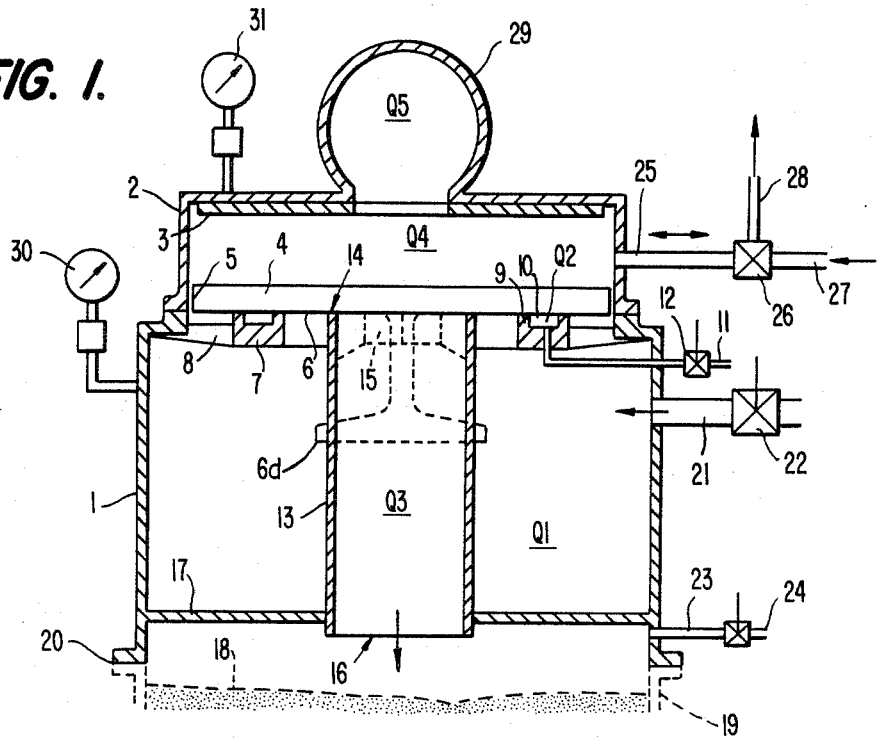
FIG. 1 is a vertical side elevation, in section, of a first embodiment of an apparatus in accordance with the invention having a circular acceleration surface.

The embodiment shown in FIG. 1 includes a pressure housing 1 which is generally cylindrical in shape and rests on the upper surface of a mould housing 19 into which has been poured a measured quantity of granular foundry mould material 18 overlying a pattern, not shown, in a conventional fashion. Above pressure housing 1 is a control housing 2 which rests in sealing relationship on housing 1. In the control housing 2 is a sealing organ 4 which is vertically movable and which has a jacket flange with a surface 5 extending along the inside of the control housing. The jacket surface 5 can be formed without a special sealing element in situations where there is equality between the pressures of the control medium and the pressure medium. However, where there is to be a difference between these mediums, where special tightness is necessary, it will be advantageous to insert a customary sealing element such as a sealing ring. On the opposite side of control housing 2 from sealing organ 4 is a seal 3 attached in such a way that the sealing organ 4 can also assume a sealing position with its reverse side.

Sealing organ 4 in the embodiment of FIG. 1 is formed in the shape of a disc, or a shallow pan, and can, depending upon the size of the opening to be covered up, also be ribbed, or be provided with some other reinforcing means. The sealing organ can be made of plastic or an elastomer or can even be made of metal, but it is advantageous to provide a metal sealing organ with an elastomeric coating.

The underside of the sealing organ 4, i.e., the side facing downwardly toward the inside of the pressure housing, is formed as a sealing surface 6. Abutting against sealing surface 6 is an annular hollow body 7 which opens upwardly and which will be identified as a reflex body. Body 7 is fixedly attached within pressure housing 1 by girders 8. A recess 10 extends inwardly from the surface of body 7 which faces and abuts against sealing surface 6, recess 10 having on both sides thereof annular ribbon-like sealing members 9 positioned toward the edges of body 7. It has been found to be advantageous to keep the sealing parts 9 narrow corresponding to the counterpressure on the sealing organ 4, and to make the depth of recess 10 between about 1.0 and 2.0 millimeters in order to keep the requirement for the filling volume of a pressurized gas to be used in that recess as low as possible. In those situations when one operates with an auxiliary pressure from a pressure tank, not shown, reces 10 is made correspondingly deeper. The sealing parts 9 and recess 10 define a reflex space Q2 which opens upwardly. As a result of the sealing parts 9 of body 7 abutting against surface 6, a so-called accelerating surface is defined on the sealing organ 4 which, in the operation of the apparatus is either covered up or uncovered. At the time of transition from a condition in which this portion is covered to an uncovered state of the accelerating surface, a quasi-reflex like tipping or overcenter effect occurs as a result of the sudden change in the surface area against which the pressure of the pressurized gas acts, thereby accelerating the sealing organ 4, causing it to be lifted away from the sealing support. The uncovering of the accelerating surface abruptly enlarges the active surface, by the amount of area of the accelerating surface, on which the pressure gas in the space Q1 acts against the surface of sealing organ 4.

Instead of recess 10 on reflex body 7, a continuous flat surface can be provided as a result of which a quasi-space is formed when the sealing surface 6 is lifted away from body 7. Such a space is less advantageous from the point of view of flow engineering because the accelerating surface must be released simultaneously to the full extent. In order that an accelerating surface can become effective, the reflex body 7 must always be used in the pressure building, pressure transporting portion of the device.

The surfaces of the sealing part 9 abutting against surface 6 may, for example, be curved or have some other geometric form for the improvement of the sealing effect.

For the purpose of influencing the pressure state in the reflex space Q2, that space is connected through a line 11 and a regulating element 12 to the atmosphere or, alternatively, to a pressure reservoir, not shown.

The connection of space Q2 with the atmosphere serves for pressure compensation after completed triggering of a pressure thrust and renewed sealing of the sealing organ 4 and, in addition, differential acceleration forces acting as a result of the pressure gas accumulated in the pressure storage on the accelerating surface of organ 4 can be released. A hollow, generally tubular body 13 is mounted centrally with respect to the annular reflex body 7 and space Q1 formed by pressure housing 1, body 13 being open at both ends and having an interior volume Q3 through which the gaseous media can pass. The upper end 14 of body 13 lies in the sealing plane of the reflex body 7 and thus fits against sealing surface 6 of organ 4. In order to control the flow conditions from space Q1 into the passage Q3 in a desirable fashion, it is possible to provide the sealing plane determined by surface 6 into various planes. A possible alternative embodiment is shown in dotted lines in FIG. 1 in which the sealing organ has an extension protruding downwardly and terminating with a sealing surface 6d.

If such an embodiment were to be used, hollow body 13 would necessarily be shortened correspondingly.

The cross sectional shape of body 13, or of passage Q3, can be made either round or polygonal. The cross sectional interior of body 13, especially if body 13 has a very large cross section, can be formed with support links or struts 15 to support sealing organ 4. Alternatively, instead of providing support links 15, the body 13 can be divided into several hollow bodies in a manner similar to FIG. 2, wherein the hollow bodies can also be formed as Laval nozzles with which an improved support for organ 4 and improved flow conditions for the pressurized gas with minimal stroke of the sealing organ 4 are created. The individual hollow bodies can be either circular or polygonal in cross section.

The lower end 16 of body 13 is tightly mounted in a bottom plate 17 of housing 1. This lower end 16 is inserted such that its opening points in the direction toward surface 18 of the poured mass of moulding material in mould housing 19.

The bottom portion 20 of the pressure housing 1 is formed with a connecting flange below plate 17 so that it can be suitably coupled to the top of mould housing 19.

The hollow space Q1 which is open toward sealing organ 4 is formed by the walls of housing 1, by the exterior of body 13 and by plate 17. This hollow space, which can be referred to as a pressure space, is connected to a feed line 21 for delivery of a medium under pressure, such as compressed air, into the pressure space so that a body of gas under pressure can be accumulated for the pressure thrust. A valve 22 is inserted in feed line 21 to regulate the supply of the pressurized medium.

In the portion 20 between the bottom plate 17 and the flange, in connection with the volume immediately above the surface 18 of the moulding substance, is a line 23 which is provided to relieve the pressure of the gas applied to the moulding material surface, this line being connected through a relief valve 24 and, possibly, a sound-damping arrangement, with the atmosphere.

At the upper end of the apparatus, a control space Q4 is formed by the walls of control housing 2, and by the upper, reverse side of sealing organ 4. A control line 25 extends through one of the walls of control housing 2, line 25 having a valve 26 which has a feed line 27 and a discharge line 28. Alternatively, it is quite possible to use separate feed and discharge lines analogous to lines 27 and 28. The sealing organ 4 can be acted upon on one side by a pressure medium such as compressed air delivered by way of the control line 25.

It is advantageous to connect the control space Q4 with a buffer space Q5 formed in an additional container 29 by which a buffer effect can be achieved in connection with the air which is rapidly moved by sealing organ 4. For this portion of the process, after pressure reduction to the sealing organ 4 has been completed and preceding a pressure compensation venting to the atmosphere, valve 26 is closed.

In order to minimize the consumption of pressurized medium, the passage or passages Q3 leading to the surface of the moulding material are closed prior to relieving the produced pressure. For the same purpose, the pressure in the control space is lowered only enough to initiate the release of the acceleration surface, as will be described. Both in the pressure housing 1 as well as in the control housing 2, pressure measuring devices 30, 31 can be built in.

Figure 2:
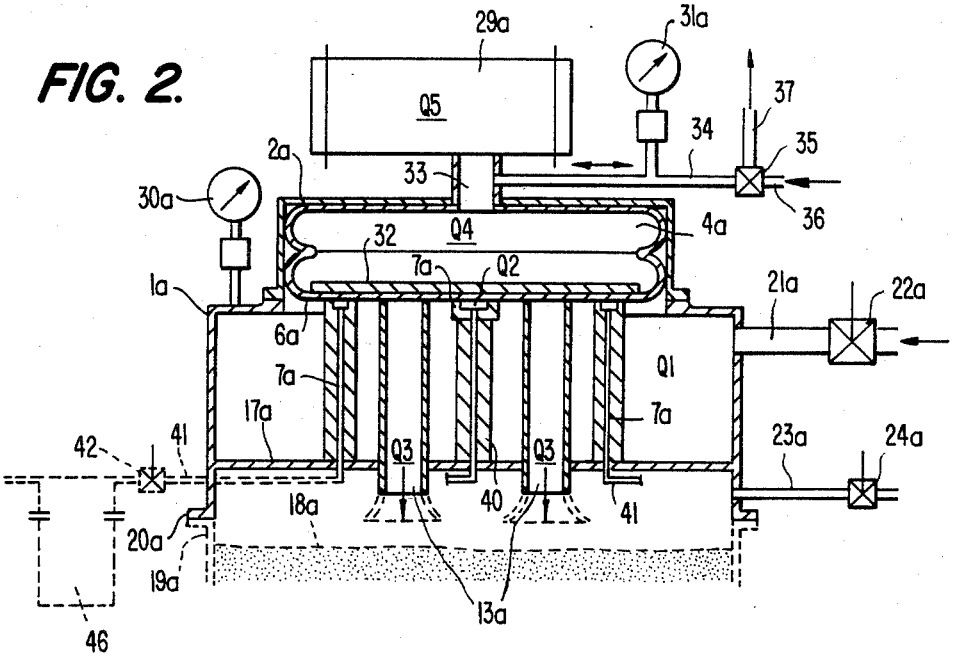
FIG. 2 is a vertical side elevation, in section, of a second embodiment of an apparatus in accordance with the invention having a plurality of accelerating surfaces.

The embodiment shown in FIG. 2 corresponds essentially to that of FIG. 1 and has a pressure housing 1*a* with a control housing 2 placed above it, the housing 1*a* being equipped with a connecting part 20*a* for connection with the moulding housing 19*a*.

FIG. 2 differs from FIG. 1 in having a plastically deformable sealing organ 4*a* and the provision of a plurality of reflex bodies 7*a* and hollow bodies 13*a*, the hollow bodies being open at both ends. The sealing organ 4*a* which is enclosed by control housing 2*a* is formed somewhat in the shape of a bellows to facilitate quick changing of moulds and consists primarily of elastomeric material. In the direction toward the sealing surface 6*a* of organ 4*a*, the sealing organ is equipped with a reinforcing plate 32 for improving the sealing support.

An additional container 29*a* is connected to the control housing 2*a* and the interior of sealing organ 4*a* by a passage 33. The sealing organ 4*a* encloses a control space Q4 and the additional container 29*a* encloses a buffer space Q5. The buffer space cooperates with the control space Q4 to accomplish a buffering effect of the recoiling sealing organ 4*a*. In order that effective braking can take place, valve 35, inserted in the feed and discharge line 34 to the sealing organ 4*a*, must be closed. Valve 35 is equipped with a feed line 36 and a discharge line 37. Feed line 36 is connected to a pressure storage vessel, not shown, which stores a pressure medium adjusted to a predetermined pressure level, this medium being used to apply force to one side of the sealing organ 4*a*. The pressure medium becomes free during the pressure reduction on the sealing organ 4*a* and is vented by way of discharge line 37 through the feed and discharge line 34.

Pressure measuring devices 30*a* and 31*a* can be inserted in the feed and return line 34 as well as in pressure housing 1*a* for monitoring the pressure.

The embodiment of FIG. 2, contrary to FIG. 1, has several reflex bodies 7*a* with reflex spaces Q2 all opening in the same direction, the bodies being supported in a circle by a bottom plate 17*a* of the pressure housing 1*a*. In order to minimize the reduction of the volume of space Q1 by the structure for support of the reflex bodies 7*a*, the bodies can effectively be mounted on space-saving supports 40. Lines 41 with control elements 42, which can be, for example, valves connected with the atmosphere or to a pressure container 46, lead into reflex space Q2. The functions of these elements are the same as those which have been described in connection with FIG. 1.

Alternating with the reflex bodies 7*a* and spaced apart from those bodies are hollow bodies 13*a* which are continuous tubes opening at both ends having interior passageways Q3. Hollow bodies 13*a* are, at the same time, inserted in sealing relationship through bottom plate 17*a* and, as a group, form a plurality of openings with their passageways Q3 directed toward the surface 18*a* of the poured granular moulding material. The passages Q3 serve to guide the released pressure thrust of the pressurized medium from volume Q1 and are advantageously provided with bell-like enlarged open ends at their exit ends.

A line 21*a* with a valve 22*a* passes through a wall of pressure container 1*a* for feeding in a pressured medium delivered from a pressure storage reservoir, not shown. This line 21*a* can also be used for evacuating chamber Q1.

A pressure release line 23*a* having a pressure relief valve 4*a* passes through the wall forming a part of the container enclosing the volume immediately above the surface 18*a* of the moulding material. Line 23*a* serves to release the remaining residual pressure of the gas which produced the pressure thrust to the upper surface of the moulding material and is disposed with its mouth in the area of the center line of the moulding space or of the space above the moulding material surface. Prior to releasing the residual pressure, the spaces Q3 are closed by sealing organ 4*a*.

Figure 3:
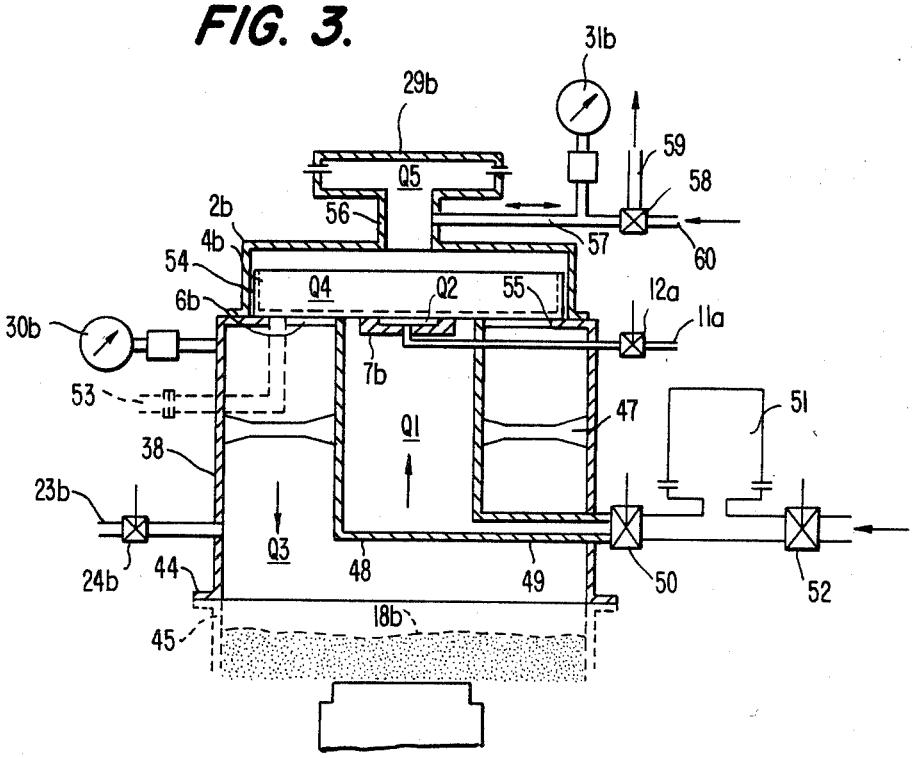
FIG. 3 is a vertical side elevation, in section. of a third embodiment of an apparatus in accordance with the invention having a centrally located acceleration surface.

The embodiment shown in FIG. 3 includes a housing 38 which is connected to a control housing 2*b*. Contrary to the preceding embodiments, in the embodiment of FIG. 3, the interior volume of the housing 38 itself forms a space Q3 which operates as a passageway and is open at both ends. The lower end of this housing 38 has a connecting part 44 which couples to the upper portion of a moulding housing 45. By means of the connecting part 44 and the customary pressure elements it is possible to connect the housing 38 with mould housing 45. The cross sectional surface of the connecting part 44 is selected in this embodiment to be similar to that of the moulding arrangement 45 with which an optimum pressure thrust transmission can be achieved. In one wall of housing 38 is a line 23*b* with a control valve 24*b* which serves to vent the pressure of the thrust applied to the surface 18*b* of the moulding sand within housing 45. Within housing 38 and connected with it by way of fixed struts 47 is a hollow body 48, opening upwardly, which is connected by a line 49 having a valve 50 to a pressure reservoir 51. Reservoir 51 is connected via a valve 52 with a source of gas under pressure.

The open end of body 48 surrounds a reflex body 7*b* having a reflex space Q2. This reflex body 7*b* is connected to body 48 by mechanical structural supports and is in the form of a disc. A conduit 11*a* is connected with the atmosphere through a valve 12*a*, or alternatively is connected with a pressure tank, not shown, in a manner similar to the previously described embodiments, conduit 11*a* leading into reflex space Q2.

An additional arrangement of discharges 53 can also be provided, cooperating with space Q3, with which it is possible to trigger the release of pressure using control elements activated simultaneously with the desired pressure thrust released. Control housing 2*b* connected with housing 38, encloses a control space Q4. In the control space Q4, or control housing 2*b*, a sealing organ 4*b* having a sealing surface 6*b* is provided. The sealing organ 4*b* is formed as a cylindrically shaped cup and can be made of metal with a coating of an elastomer or can be formed from a polymeric plastic material.

The upwardly extending angular jacket surface 54 of sealing organ 4*b* is advantageously inserted into the housing in a sealing relationship or with very little clearance. If clearance is provided, it is advantageous to form marginal surface portions 55 with a seal to prevent the leakage of pressure medium operating in control space Q4.

Control housing 2*b* is provided with an additional space 29*b* which is connected to control housing 2*b* by a passageway 56. Control line 57 opens into passage 56, the control line having a valve 58 so that the conduit can be closed, or can be connected to a discharge line 59 for a source of gas under pressure through conduit 58. In the feed line 57 for the pressure medium, as well as in the housing 38, pressure measuring devices 30*b*, 31*b* are effectively inserted.

Figure 4:
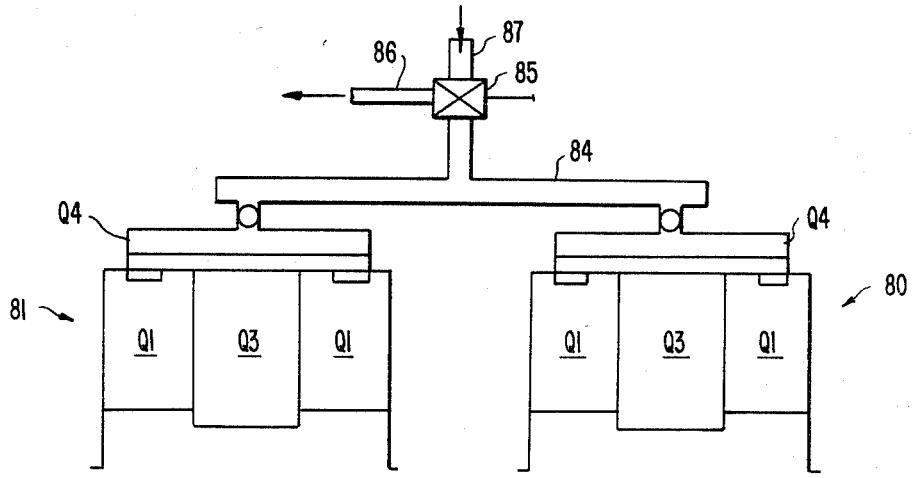
FIG. 4 is a schematic side elevation of an apparatus in accordance with the invention showing the use of multiple arrangements.

FIG. 4 shows a further embodiment having several simultaneously applied arrangements acted upon by a control arrangement, in schematic form. As shown therein, the apparatus includes pressure chambers indicated generally at 80 and 81 having spaces Q1 and Q3 therein, each of these pressure housings being adapted to rest on mould housings as previously discussed in connection, for example, with FIG. 1. Above the pressure housing in each case is a control housing with an interior space Q4. The space is connected to a control conduit 84 which is coupled through a valve 85 to a vent conduit 86 and to a conduit 87 which leads to a source of gas under pressure.

Figure 5:
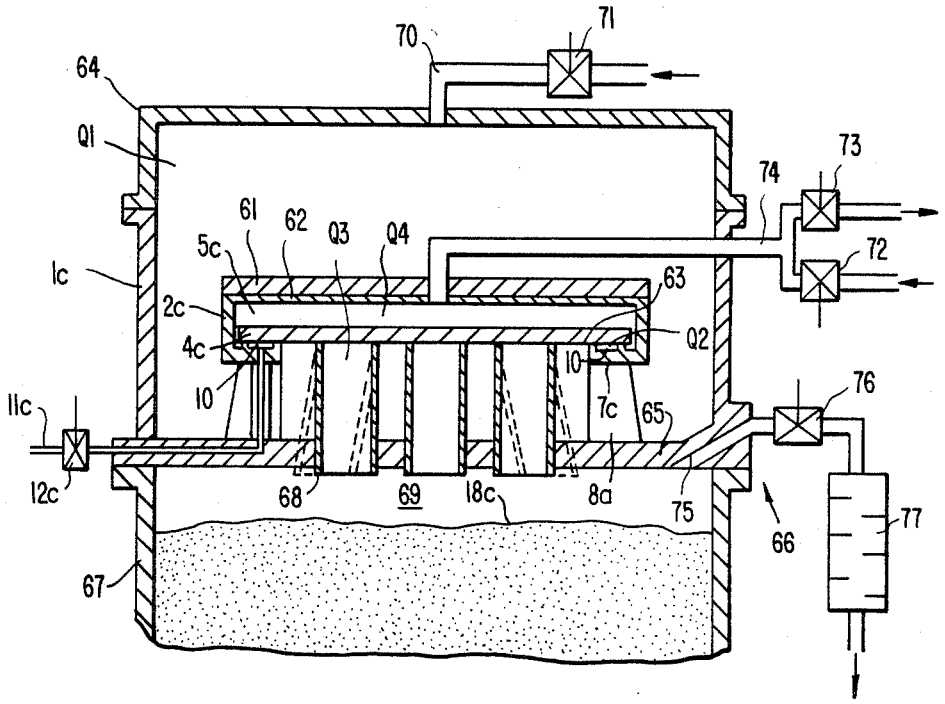
FIG. 5 a vertical side elevation, in section, showing yet another embodiment of an apparatus in accordance with the invention.

FIG. 5 shows an embodiment which includes a simplification of the sealing arrangement of the sealing organ 4*c* in control space Q4 and a modification of this relationship with the pressure space Q1 which permits greater clearance between the sealing organ and the inside jacket surface of control space Q4. As a result of this modification, a substantially frictionless movement of the sealing organ 4*c* is made possible, having a favorable effect upon the effectiveness of the pressure thrust.

FIG. 5 shows in detail a pressure housing 1*c* with a control housing 2*c* disposed within the pressure housing and supported therein by spacing yokes 8*a*. In control housing 2*c* is inserted sealing organ 4*c* in such a way that it is movable along the inner jacket surface 5*c* of the control housing. A cover 61 constitutes the upper closure of housing 2*c* and a sealing shoulder 7*c* constitutes the lower wall of a reflex body on which the sealing organ 4*c* rests. Both the cover 61 and shoulder 7*c* can be releasably attached to the control housing 2*c*. The inside of cover 61, facing toward the control space, is provided with a layer of elastomeric material for the control-side sealing with sealing organ 4*c*. The upper portion of shoulder 7*c*, facing upwardly toward the sealing organ, is formed with an annular sealing surface 63 and has an annular recess 10*c* which, together with the sealing organ 4*c*, defines a space Q2. This space is connected with the atmosphere through a conduit 11*c* which can be opened or closed by a valve 12*c*.

A hood-shaped cover 64 forms the upper closure of pressure housing 1*c* and a bottom plate 65 constitutes its lower closure. Plate 65 is provided with a connecting arrangement 66 by means of which the pressure housing can be coupled, as a complete compression unit, to the upper opening of a moulding assembly 67. A plurality of hollow tubular bodies 68 are mounted in and pass through plate 65 and extend upwardly to the plane containing sealing surface 63 of shoulder 62 and project into pressure space Q1. Bodies 68 can be oriented in parallel relationship with each other or can be splayed outwardly, the lower ends thereof being directed generally toward the volume 69 above the surface of moulding substance 18*c*. The exact arrangement of bodies 68 depends largely upon the lateral extent of the surface 18*c* of the moulding substance.

The lower surface of sealing organ 4*c* rests in sealing and support relationship on the upper pressure-side ends of hollow bodies 68 and on the sealing shoulders 63 supported on surface 7*c*, organ 4*c* separating the control space Q4 from the pressure space Q1. Recess 10*c* constitutes a reflex space Q2. The interior of bodies 68 comprise passageways Q3. Because of the contact of sealing surface 63 of shoulder 7*c* with organ 4*c*, an acceleration surface on the sealing organ 4*c* is covered up and becomes effective during lowering of the control pressure in space Q4 on the sealing organ and as a result of the increased pressure action from the pressure space Q1 on the sealing organ 4c, i.e., after the quasi-reflex-like tilting action of the pressure course of the pressure gas. A pressure line 70 extends through cover 64 of housing 1c into space Q1 and leads to a source of gas under pressure, the influx of which is controlled by a valve 71. Outside of pressure housing 1c, the supply of the control pressure medium, which can also be compressed air, is controlled by means of valves 72 and 73 through a line 74 which passes through a side wall of the pressure housing and extends through cover 61 of control housing 2c into the control space Q4. Valve 72 serves as an inlet valve and valve 73 as a vent valve. A multi-way valve can be alternatively used. A pressure venting line 75 extends through a side wall of housing 1c into mould volume 69. The mouth of line 75 is preferably disposed in the area of the center axis at the greatest possible distance from moulding surface 18c of housing 67 and ensures optimal venting. This venting line 75 is controlled by a valve 76 and is preferably connected through a muffler 77 with the atmosphere. All valves 12c, 71, 72, 73 and 76 are preferably connected to a central control installation but may also be operated individually.

Beginning with the initial conditions that an arrangement in accordance with the invention is connected, ready for moulding, with a moulding arrangement which contains granular mould material requiring compacting, the operation proceeds essentially as follows.

Reflex space Q2 of the reflex body is vented to atmospheric pressure. Subsequently, the valve leading to the control line can be opened and a control pressure can be built up on the reverse side of the sealing organ. The sealing organ, under the action of the control pressure, fits in sealing relationship against the sealing surfaces and, by doing so, isolates the pressure space Q1, the reflex space Q2 and passageway Q3 from each other, after which the main valve for the supply of pressure medium which is to be provided for the pressure thrust can then be opened and the pressure space Q1 can be filled or enriched with pressure medium. As a result, the pressure medium, which can be compressed air, in space Q1 acts as a counterpressure on the sealing surface of the sealing organ counter to the control pressure. Thus, it will be recognized that, when the pressures on both sides of the sealing organ in spaces Q4 and Q1 are approximately the same as each other, the force exerted by the control pressure on the sealing organ is always greater than the force which acts from the direction of the pressure space and it will further be recognized that the spaces constitute a closed system.

It is advantageous to keep the pressure on both sides of the sealing organ nearly equal so that any possible leakages in this area become insignificant. Since the active surface of the sealing organ on the control side is always the larger surface area, secure sealing always will exist when the pressures are equal.

Under these circumstances, the space Q1 is now filled with compressed air. Since the so-called reflex body is disposed in that space in which a pressure is just being built up, the reflex body thereby is engulfed by compressed air except for that side which is covered up by the sealing organ. The surface portion of the sealing organ which has been referred to as the acceleration surface will then be covered by this side of the reflex body. If a pressure thrust is then to be delivered to the upper surface of the mass of moulding material, it is necessary for there to be a reduction in the pressure of the medium in control space Q4 and such pressure is lowered until it drops below the state of equilibrium, beyond the so-called break-over or transition point. Because the state of equilibrium no longer exists, i.e., at the time from the covered to the released state of the acceleration surface, the pressure of the compressed air on the pressure space side now acts with a reflex-like tipping action of the pressure state abruptly exerting a greater force on the sealing organ and lifts that organ from the covered side of the reflex body, i.e., of the acceleration surface. Thus, for a brief time, the surface being acted on by the pressurized gas acting from the Q1 side is enlarged and the sealing organ is lifted up promptly, thus freeing the access to the passage space Q3. As a result of the abrupt opening of the passage space, the air which has been built up under pressure in space Q1 can be relieved just as promptly and act as a pressure thrust on the mass of moulding material.

It has been found to be advantageous to delay the release of the sealing surface on the body defining passage Q3 with respect to the sealing surface on the reflex body to improve the transition from the state of equilibrium of the sealing organ, i.e., the acceleration surface is exposed first, the release being in the order Q1, Q2, Q3.

Simultaneously with the action of the pressure thrust it is advantageous to close the valve leading to space Q4 to thus capture the residual compressed air in control space Q4 and buffer space Q5. This residual pressurized air is more compressed by the quick movement of the sealing organ and, thus, exerts a braking action on the sealing organ. In order to make the optimum use of the action of the pressure thrust achieved by the pressurized air having been released, it is possible for one to arrange the sealing surfaces in different planes with respect to each other. It is also possible to arrange the flow-through cross section so that it is distributed to several passages Q3, or to arrange the several passages in the manner of rays, in the splayed fashion previously described in connection with FIG. 5.

The surfaces of the sealing organ, defined by the openings of the spaces, thus determine the partial surfaces with various purposes and with their sum form the entire sealing surface of the sealing organ. After the pressure thrust has been applied to the moulding material surface and thus accomplishing compaction of the mass of moulding material, the passageway or passageways Q3 are closed by the sealing organ and the supply of pressure medium is interrupted.

After the completion of a compaction process, residual pressure always exists in the volume above the moulding material surface. Thus, before the moulding unit can be separated from the compaction apparatus in accordance with the invention, the pressure must be relieved by opening a vent valve such as valve 24 in FIG. 1 or valve 76 in FIG. 5. Before this, the pressure supply lines are closed, keeping the consumption of pressurized air within economically favorable limits.

After this venting, the moulding unit can be replaced by a new one containing moulding material which is to be compacted, and the new moulding cycle can be commenced.

The embodiments described above have features which can be selectively combined or expanded by additional embodiment features. It is also possible to use different media for the pressure thrust when this seems indicated, or to use compressed air or an inert gas in the control space.

The advantages which can be achieved with the process consist particularly in that when one is using a moulding arrangement having a large cross section in the thrust passageways, the sealing organ can be made quickly movable with relatively small construction costs, resulting in an apparatus with which pressure thrusts of various intensities and of a predeterminable order of magnitude are achievable. By combining features of individual embodiments disclosed herein, it is possible to cover various moulding arrangements and the moulding material masses contained therein can be compacted according to their individual requirements.

The use of the present invention, particularly of accelerating surfaces for the purpose of achieving a tilting point in the pressure curves on the sealing organ is not restricted to use as stated herein, but can be used in other circumstances where large cross sections of passage conduits must be opened quickly and voluminous quantities of pressurized gas must be conveyed promptly.

While certain advantageous embodiments have been chosen to illustrate the invention, it will be understood by those skilled in the art that various changes and modifications can be made therein without departing from the scope of the invention as defined in the appended claims.

What is claimed is:

1. A method of compacting granular material, especially granular foundry moulding material, using the thrust of a pressurized gas against the exposed upper surface of a mass of moulding material loosely poured around a pattern, comprising the steps of establishing first, second and third volumetric spaces Q1, Q2 and Q3 all having openings facing in the same direction and having edges surrounding the openings, space Q3 additionally having a second opening facing toward the exposed surface, providing a sealing organ having at least one sealing surface movable between a sealing position in which the sealing surface closes the openings of spaces Q1, Q2 and Q3 and a released position in which the organ is spaced from the openings, establishing a pressurizable control space Q4 at least partially surrounding the organ and acting against a surface of the organ facing away from the sealing surface such that pressurized gas therein tends to urge the organ towards its sealing position, the surface area acted upon by the gas in space Q4 being greater than the surface area acted upon by the gas in space Q1, supplying a gaseous medium to space Q4 until the space is pressurized to a predetermined pressure level to hold the sealing organ in its sealing position, delivering a gaseous medium under pressure to space Q1 until that space is pressurized to a substantially equal or higher pressure level than space Q4, no greater than 19 bar, the higher level being less than that required to overcome the force of the gas in space Q4, and abruptly decreasing the pressure in space Q4 to allow the force exerted by the gas in space Q1 to overcome the force exerted by the gas in space Q4, thereby abruptly moving the sealing organ away from the openings of spaces Q1, Q2 and Q3 and suddenly increasing the surface area of the sealing organ acted upon by the pressure of the gas in space Q1, thereby fully moving the sealing organ away from spaces Q1, Q2 and Q3 and allowing sudden expansion of the gas in space Q1 to pass through space Q3 and create a pressure thrust against the moulding material surface, thus compacting the material.

2. A method according to claim 1 wherein each gaseous medium is compressed air.

3. A method according to claim 2 wherein the sealing organ is simultaneously moved away from the opening of all of spaces Q1, Q2 and Q3.

4. A method according to claim 2 wherein the sealing organ is sequentially moved away from the openings of the spaces in the order Q1, Q2, Q3.

5. A method according to claim 2 wherein the pressure in space Q4 acting on the sealing organ is increased and decreased in a controlled manner.

6. A method according to claim 5 and further including the step of relieving the pressure applied to the exposed surface of the moulding mass in a controlled fashion.

7. A method according to claim 2 wherein the pressure of the gaseous medium in space Q1 is between about 4 and about 8 bar.

8. A method according to claim 7 wherein, before abruptly decreasing the pressure in space Q4, the pressure in space Q1 is different from the pressures in spaces Q2 and Q3.

9. A method according to claim 8 wherein the pressure in space Q2 is predetermined.

10. A method according to claim 2 wherein, after moving the sealing organ away from the openings, an equal pressure is built up in space Q3.

11. A method according to claim 10 wherein the pressure thrust is simultaneously guided into several spaces.

12. A method according to claim 11 wherein the direction of the pressure thrust is selectable.

13. An apparatus for forming and guiding a gas pressure thrust for compacting granular moulding material, especially foundry moulding material, the material being loosely poured into a mould housing surrounding a pattern, the apparatus comprising the combination of a pressure housing having an interior volume Q1 and an outlet opening;

means for supplying gas under pressure to said pressure housing to a predetermined pressure level;

a control housing having an interior volume Q4;

means for supplying gas under pressure to said control housing to a preselected pressure level;

means defining at least one passageway extending from an inlet opening in a predetermined plane to an outlet opening facing said moulding material, said at least one passageway having an interior volume Q3, said inlet opening facing in the same direction as said outlet opening of said pressure housing;

seal means in said control housing for closing said outlet opening of said pressure housing and said inlet opening of said passageway, said seal means being movable between a closed position in which said openings are isolated from each other and a release position in which said openings are uncovered and in fluid communication with each other, the gas under pressure in said control housing urging said seal means toward said closed position, and the gas under pressure in said pressure housing urging said seal means toward said release position;

means defining an accelerator chamber having a volume Q2 and having an opening facing in the same direction as said outlet opening of said volume Q1 and said inlet opening of said volume Q3, said opening of said volume Q2 being closed by said seal means when said seal means is in said closed position, said means defining said chamber being effective to cover an accelerator surface portion of said seal means so that the surface area of said seal means acted upon by said gas in said volume Q1 is less than the surface area of said seal means acted on in the opposite direction by said gas in said volume Q4; and vent means for selectively decreasing the pressure in said volume Q4, whereby said volumes Q1 and Q4 can be pressurized to a substantially equal pressure level while holding said seal means in said closed position, after which the pressure in said volume Q4 can be abruptly decreased, permitting the force exerted by the gas in volume Q1 to move said seal means away from the volume Q2, suddenly enlarging the surface area acted upon by the gas in volume Q1 and reversing the force balance such that said seal means is abruptly moved to the release position, allowing the gas in volume Q1 to expand and pass rapidly through said at least one passageway to exert a sudden force on the exposed surface of said moulding material to thereby compact said material.

14. An apparatus according to claim 13 wherein said means defining said accelerator chamber is supported by said pressure housing and forms a sealing shoulder directly connected to said control housing, said chamber comprising a recess therein.

15. An apparatus according to claim 13 wherein said chamber having a volume Q2 is formed as an annular recess.

16. An apparatus according to claim 13 wherein said chamber having a volume Q2 comprises a disc-shaped body having a central recess therein.

17. An apparatus according to claim 13 wherein said means defining an accelerator chamber comprises a column having a recess formed in one end thereof.

18. An apparatus according to claim 13 and further comprising means normally interconnecting said volume Q2 with the atmosphere.

19. An apparatus according to claim 13 and further comprising means normally interconnecting said volume Q2 with a source of gas under pressure.

20. An apparatus according to claim 13 and further comprising means defining a vent passage extending into the volume adjacent the exposed surface of said moulding material.

21. An apparatus according to claim 20 wherein the inner end of said means defining a vent passage is disposed adjacent the central axis of the volume above the surface of said moulding material.

22. An apparatus according to claim 13 and further including a plurality of means defining a plurality of accelerator chambers having volumes Q2 circularly disposed relative to the central axis of said pressure housing;

and said means defining at least one passageway comprises a plurality of tubular passageways circularly disposed in spaced relationship relative to said central axis, said passageways being alternated with said means defining accelerator chambers.

23. An apparatus according to claim 13 wherein said sealing organ comprises a sealing surface lying in one plane in said closed position, and wherein said one plane contains said outlet opening of said pressure housing, said inlet opening of said at least one passageway and said opening of said volume Q2.

24. An apparatus according to claim 13 wherein the inlet opening of said at least one passageway lies in a different plane from said opening of said accelerator chamber.

25. An apparatus according to claim 13 and further comprising a buffer chamber having a volume Q5, and means interconnecting said buffer chamber with said control chamber.

26. An apparatus according to claim 13 wherein said seal means comprises a disc-shaped plate.

27. An apparatus according to claim 13 wherein said seal means comprises a deformable hollow body.

28. An apparatus according to claim 13 wherein said sealing organ comprises a plate formed of a polymeric, plastic material.

29. An apparatus according to claim 13 wherein said seal means is formed at least partly from an elastomeric material.

30. An apparatus according to claim 13 wherein said seal means comprises a metallic plate, the sealing surface of which is coated with an elastomeric material.

31. An apparatus according to claim 13 wherein said recess comprises a hollow space in said sealing surface, closed by said seal means.

32. An apparatus according to claim 13 and further comprising means for interconnecting said recess with the atmosphere.

33. An apparatus according to claim 13 wherein said seal means forms a closing seal in either of said closed and release positions.

34. An apparatus according to claim 13 wherein said at least one passageway comprises a plurality of tubular members mounted in said pressure housing and disposed in parallel relationship with each other.

35. An apparatus according to claim 13 wherein said at least one passageway comprises a plurality of tubular hollow bodies mounted in said pressure housing and with the outlet openings thereof spaced further from each other than the inlet openings thereof.

36. An apparatus according to claim 13 wherein the sum of all partial surfaces on said seal means corresponds to the sealing surface.

* * * * *